United States Patent [19]

Gundersen et al.

[11] Patent Number: 4,771,168

[45] Date of Patent: Sep. 13, 1988

[54] LIGHT INITIATED HIGH POWER ELECTRONIC SWITCH

[75] Inventors: Martin Gundersen, San Gabriel; George Kirkman, Los Angeles, both of Calif.

[73] Assignee: The University of Southern California, Los Angeles, Calif.

[21] Appl. No.: 46,405

[22] Filed: May 4, 1987

[51] Int. Cl.[4] ..... H01J 40/14

[52] U.S. Cl. ..... 250/211 R; 313/538

[58] Field of Search ..... 250/211 R, 211 J, 432–438, 250/207; 313/523, 532, 538, 539

[56] References Cited

U.S. PATENT DOCUMENTS

| | | | |
|---|---|---|---|
| 3,246,158 | 4/1966 | Bell | 250/211 R |
| 3,609,435 | 9/1971 | Lewis | 313/538 |
| 4,335,465 | 1/1979 | Christiansen et al. | 376/156 |

OTHER PUBLICATIONS

"Pseudo-Spark Chambers for the Generation of Intense Pulsed Electron Beams," J. Christiansen.

"The Triggered Pseudo-Spark Chamber as a Fast Switch and as a High-Intensity Beam Source," D. Bloess et al., Nuclear Instruments & Methods, vol. 205, Nos. 1,2, 1/15/83, pp. 173–184.

"The Triggered Pseudo-Spark," J. Christiansen et al., Paper to be Presented at XVIth Int'l Conf. on Phenomena in Ionized Gases, Dusseldorf, 9/29–9/2/83 (Geneva, Switzerland 4/83).

Triggered Pseudospark Chamber (Bloss et al.) V.205 pp. 173–184 (1983).

Investigation of a Laser Triggered Spark Gap by: Arthur H. Guenther et al. pp. 1546–1550 (1965).

*Primary Examiner*—David C. Nelms

*Attorney, Agent, or Firm*—Poms, Smith, Lande & Rose

[57] ABSTRACT

The invention disclosed herein includes a low pressure, light initiated, glow discharge switch for high power application. The switch is comprised of an insulating envelope formed into a cylindrical shape having conductive plates at each end. Contained within the envelope is a cathode cup and an anode cup. Each of the cups has a plate at one end which defines two central apertures. The central apertures are positioned opposite one another a short distance apart and centrally axially aligned. A quartz window at the lower end of the cathode cup defines a visual opening to allow unfocused high energy electromagnetic radiation (UV light) to be shined upon the back side of the cathode plate. When UV light is presented to the back of the cathode plate, a photoemissive mechanism is initiated which causes an avalanche effect in the gas-filled chamber of the switch which leads to the discharge of current across the gap between the anode and cathode allowing the switch to close. A system includes the electronic switch is also disclosed which may be used to trigger a high energy flash lamp or excimer laser, as well as other high power applications. A system for controlling the flow of gas into the chamber defined by the envelope of the electronic switch is also disclosed.

12 Claims, 2 Drawing Sheets

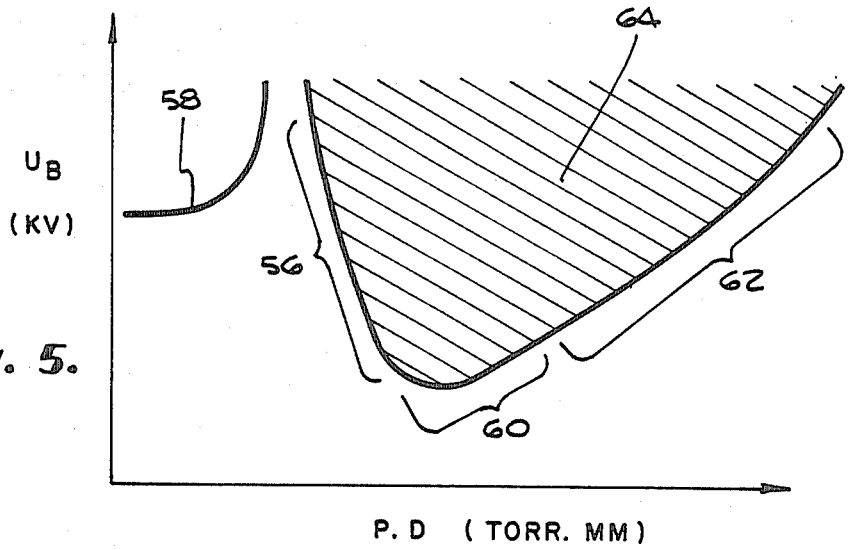
Fig. 5.
Fig. 6
PRIOR ART
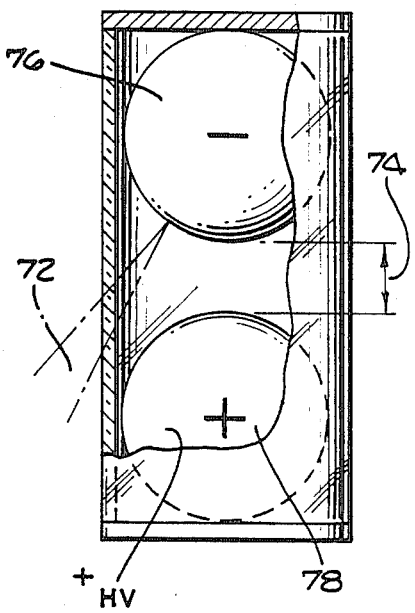
Fig. 7.
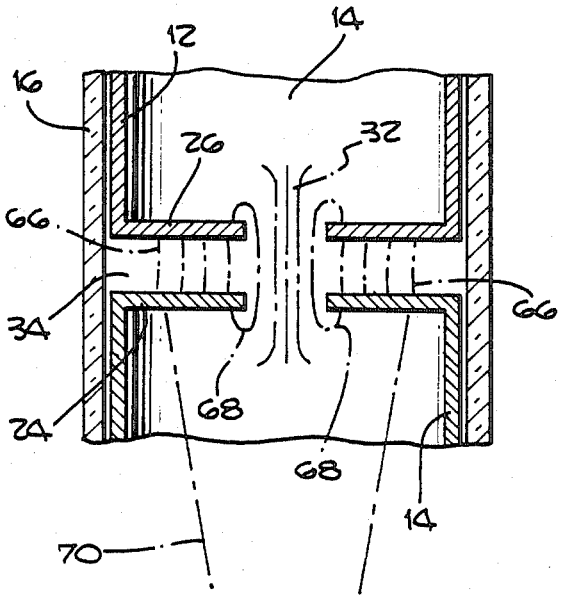

LIGHT INITIATED HIGH POWER ELECTRONIC SWITCH

FIELD OF THE INVENTION

This invention was made with government support under the following contracts awarded by the following agencies:

(1) Grant No. ECS-8311642, National Science Foundation; and (2) Grant No. DAAG29-85-K-0240, Joint Sponsorship of the U.S. Army Research Office and Air Force Office of Scientific Research.

The government has certain rights in the invention.

This invention relates to high power switches, and in particular to a gas-filled, low pressure, glow discharge switches for high power applications.

BACKGROUND OF THE INVENTION

High power triggering switches have broad application and are used in conjunction with radar microwave source switching, particle accelerators, gyrotrons, free electron lasers, and relativistic magnetrons. In particular, such high power switches are used to trigger excimer and other gas lasers.

Excimer lasers require an active medium, such as an excited rare-gas (i.e. ArF, KrF, or XeCl). In order to achieve this acceleration of electrons, high voltage and amperage is necessary.

Likewise, doped-insulator lasers, such as ruby optical medium lasers, may be rapidly "pumped" optically by a xenon flashlamp which operates with current densities in excess of 100 amperes/cm$^2$. High voltage (in excess of 20 KV) pulses are needed to ionize the gas inside the xenon flashlamp. The flashlamp must operate rapidly, providing a current path for discharging high amperage current which flows through the flashlamp.

In addition to the ability to carry high voltage and high current (resulting in a megawatt power transfer), switches used in conjunction with lasers and optical pumps, like those switches that activate the xenon flashlamp, must be operated with a fast risetime in order to create a population inversion in the active lasing medium.

Due to the need for any switch used to trigger and pulse a laser optical pump to be able to carry a high voltage, high current, and high current density, as well as being able to rapidly switch yet control voltage breakdown with a fast rise time, semiconductor switches are not the best suited pulse generators for high power laser system applications.

Among the electronic switches used as a trigger or pulse generator in a laser system is the thyratron, a gas-filled triode tube having an anode, cathode, and control grid. The thyratron operates in either a quiescent state where no current is passed or in a firing state which allows the controlled discharge of high current through its ionized gas chamber. One type of thyratron is the model HY3202 manufactured by EG & G, Inc., Electro-Optics Division, Salem, Mass. (for use in conjunction with the Lambda Physik Laser), which is a heated cathode design. Unlike conventional thyratrons which are triggered at their grid, the model HY3202 thyratron receives a trigger pulse at its cathode, which renders a grounded-grid positive with respect to the cathode. Electrons injected from the heated cathode, after triggering, travel through the grid space and into the region between a positive anode and the grounded grid. A low impedance spark arises between the anode and grid, allowing high current to flow in the tube while protecting the cathode from excess wear. (An improved version of the Model HY 3202 is manufactured by English Electric Valve, Ltd. of Chelmford, Essex, England.) Thyratrons offer fast risetime, low internal resistance, easy ignition by an external trigger and rapid recovery; but, they suffer from electrode wear.

The pseudospark, a high powered fast switch, was disclosed by D. Bloess, et al., in *Nuclear Instruments Methods* 205, 173 (1983). In this article the authors describe a multigap "pseudospark" chamber for producing a controlled trigger mechanism for the fast switch. The thyratron and "pseudospark" chamber switches, generally operate according to a law of electro-physics known as Paschen's law. Paschen's law defines the ability of gases to hold off a large voltage before "breakdown" and current flow as a function of the product gas pressure and the spacing between electrodes.

Experimental plots verifying Paschen's law, when plotted on a graph (See FIG. 5) having the horizonal axis measured in (p.d) (the product of pressure times distance between anode and cathode or cathode and grid) against a vertical axis measured in breakdown voltage, looks like a U-shaped curve (in (p.d) ranges above vacuum conditions). At values above 25 to 40 mbar.mm, a near linear rise appears, so that high pressure tubes having electrodes positioned a fixed distance apart show greater control the farther electrodes are positioned from one another. This region is known as the right side (62) of the Paschen curve (An example of an electronic switch operating in this right side will be discussed later in this section).

The Paschen curve bottoms out at about 7–13 mbar.mm, and as pressures are lowered below this range down to $10^{-3}$ Torr, (a Torr equals approximately 1 mbar; 760 Torr equals one atmosphere pressure) the left side (56) of the Paschen curve exhibits a sharp rise in the curve. On this left side of the Paschen curve, by precisely and sharply lowering internal gas pressure within a gas filled tube, control of triggering may be maintained into the high voltage range. Grid-controlled thyratrons and the triggered pseudospark chamber described by Bloess operate on the left side of the Paschen curve in the lower distance-pressure regions. These switches, however, due to the need for a physical grid, have a higher impedance; and, the grid and cathode (even in cold cathode switches) experience degradation and limited life. Also, triggering by means of a physical grid interposed between the anode and cathode means use an electrode trigger which is electrically coupled to the controlled high powered circuit. This electrical coupling of the controlled main circuit (necessarily high power to trigger lasers) to the trigger necessarily introduces inherent safety problems.

To avoid the safety problems of a grid which is coupled to the controlled anode-to-cathode circuit, a laser triggered spark gap was proposed in the November, 1965 issue of the *Review of Scientific Instruments,* Volume 36, at page 1546, authored by A. H. Guenther, et al.

The spark gap switch proposed by Guenther et al. comprised a high pressure gas-filled chamber having two 5 cm diameter stainless steel anode and cathode electrodes spaced 1.5 cm apart. A focused laser beam was directed by a 50 mm lens at a focal point midway between the two electrodes along a line joining their respective centers. Controlled voltage breakdown and flow of current between the electrodes was initiated by the focused laser beam. Gas pressure in the chamber of this spark gas switch was held at about 600 Torr (or nearly one atmosphere gas pressure). The laser focal point was moved over a range between 0.335 cm and 0.0 cm from the cathode. Focusing the laser beam on the surface of the cathode electrode indicated arc formation by thermionic emission of electrons from the electrode surface, as well as blow off of gaseous products from a surface irradiated by a focused laser. These ejected gases may be composed of electrode material and absorbed gaseous dielectric. Guenther reported that the largest triggerable region (outside the self-breakdown region (64) of the Paschen curve) occurs when the focused laser beam is directed onto the surface of the cathode.

A laser triggered spark gap of the prior art is shown in FIG. 6. A focused laser beam 72 is directed at the surface of the cathode 76. It will be noted that cathode 76 and anode 78 are separated by a wide gap between the electrodes in the region of 1.5 cm. The cathode and anode of the Guenther apparatus are preferably spherical and are placed in a high pressured gas filled container 80. Triggering of this switch is initiated when the high powered laser beam 72, focused on the surface of the cathode 76, creates a plasma from the cathode material which lifts into the gas filled chamber and ionizes the gas between the electrodes causing a spark gap across the electrodes to form.

Guenther concluded (at page 1550) that a laser triggered high pressure spark gap switch has low jitter, short response time, and good switching technique, due to the electrical isolation of the optically coupled focused laser beam trigger. He also concludes and teaches that high pressure triggering is easier and safer than lower pressure triggering.

Thus, the state of the art clearly indicates that laser triggered spark gap switches operate at high pressures with a relatively wide gap between adjacent spherical electrodes. The use of a high power focused laser beam to trigger the switch (on the right side of the Paschen curve) results in the laser or subsequent streamer arcing producing permanent cathode damage. At the other end of the Paschen curve, the left side, thyratrons and "pseudospark" switch operate but are triggered by electrically coupled grids providing impedance and delay in rise time, as well as control grid and anode degradation.

It is an object of this invention to provide a high power electronic switch which draws from the advantages of the designs of grid controlled thyratrons, as well as laser triggered spark gap with as good or better statistical parameters during operation of the switch and which will provide an electronic switch having good operating characteristics over a longer life.

Such a switch should perform in a variety of environments, including that of a high acceleration particle system.

An electronic switch is needed with improved stand-off voltage, peak current, current rate of rise, lifetime, and low jitter repetition rate.

These and other objects are addressed by the disclosed invention herein.

SUMMARY OF THE INVENTION

This invention relates to a high powered gas-filled electronic switch, capable of providing high stand off voltage. The electronic switch has an elongated cylindrical anode cup having a bottom plate defining a first central aperture. The switch also includes an elongated cylindrical cathode cup having a top plate defining a second central aperture. The anode and cathode cups are juxtaposed anode bottom plate to cathode top plate and separated by a small gap. The cups are positioned so that their respective apertures are in axial alignment. An elongated hermetically sealed envelope surrounds the anode and cathode cup. The envelope is sealed at both ends by an upper and lower end cap. Unfocused light is directed on the back side of the top plate of the cathode. The light transmitted to the back side of the cathode is of a wavelength short enough to trigger the flow and discharge of high amperage current across the gap and between the top and bottom plates, by means of a photoemissive mechanism.

The unfocused light is directed through a medium such as a quartz window that is capable of transmitting a band pass of electromagnetic radiation from infrared to ultraviolet, where optimally a wavelength of 308 nanometers or less is used as the triggering light. The high amperage current which flows across the gap between the two respective central apertures of the anode and cathode plates includes a high current density plasma. Prior to breakdown, the switch of this invention operates on the left side of the Paschen Curve.

The electronic switch is filled with helium or hydrogen gas maintained at a pressure within the range of 0.1 to 0.5 Torr. The discharge of the high amperage current across the gap between the top and bottom plates is a result of a photoemissive mechanism, followed by an avalanche of high current flow.

The gas filled high powered electronic switch may be used in conjunction with a system for switching a high energy load such as a laser. The switching system comprises the electronic switch which has an anode and cathode cup. The anode and cathode cup are contained within an elongated hermetically sealed envelope which surrounds the anode and cathode cup. At one end of each cup is a plate defining a central aperture through which the flow of discharge current may pass when the switch is closed. A high voltage energy source is tied to the anode of the switch by way of an electrical energy storage means such as a high storage capacitor tied to a high resistance resistor. The electronic switch controls the electrical energy storage means, in that when the switch is opened, the capacitor stores the energy providing a high voltage stand-off in the anode plate. When the switch is closed, by providing the back of the cathode with a source of unfocused light, the electrical energy storage means discharges through the load and current flows through the closed switch. Once the capacitor of the storage means fully discharges into the load, the high voltage source fills the capacitor through the high resistive load which in turn brings the anode to a high voltage potential thereby reopening the switch and preparing the switch for the next cycle of operation.

The switch of this invention operates similarly in some respects to the thyratrons and pseudosparks but differs in that the conductive phase is light activated by the unfocused light source at the central apertures and the back of the cathode, away from the region where the cathode directly faces the anode. The electrodes are typically separated by a distance of 3 mm, the same distance as the diameter of the central aperture of the cathode and anode plates. No cathode heater is required in the switch of this invention. Up to 35 kilovolts standoff voltage is achieved and a ten kilo-ampere peak current has been obtained. The current rate of rise has been measured as fast as $4\times10''$ amps/sec. The resulting electronic switch that is light activated at the back of the cathode is a low pressure gas filled switch with a simplified switch structure and a substantially reduced switch impedance, due to the fact that no control grid is necessary. The unfocused laser or light source initiates the discharge of current through photoemission, rather than through the formation of a plasma at the surface of the cathode, as in the Guenther spark gap device. Heretofore, it has not been possible with a high current switch to initiate discharge through photoemission, as it has not been possible to fabricate devices that have photosensitive cathodes capable of operation in a low pressure region of the Paschen curve. The effect of the light or unfocused laser beam shining on the back of the cathode does not produce permanent cathode damage. Experimentation has confirmed that the least degradation occurs within the area where the laser is incident on the cathode, for some configurations of the invention. This is the opposite from the situation of laser triggered spark gaps. The back of the cathode light activated electronic switch disclosed herein is reliably triggered by light without electrode degradation by the laser, and yet operates at a high stand-off voltage and high peak current.

BRIEF DESCRIPTION OF THE DRAWINGS

FIG. 5 shows a plot of the Paschen curve showing the region of gas pressure in which the electronic switch of this invention operates.

FIG. 6 is a cross-sectional view of a prior art laser triggered spark gap discussed previously in the BACKGROUND section of this invention.

FIG. 7 shows an enlarged cross-sectional view of the light initiated high powered electronic switch of this invention revealing the standoff voltage field lines and the operative pathways through which current is discharged.

DETAILED DESCRIPTION OF THE PREFERRED EMBODIMENT

Figure 2:
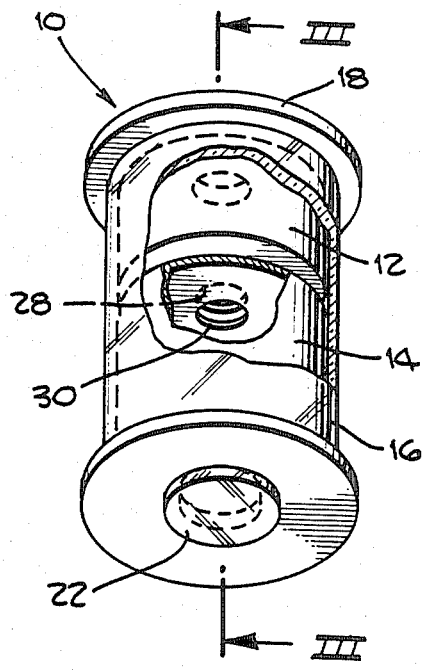
FIG. 2 is a perspective, partially sectional view, of the light initiated high power electronic switch of this invention.
Figure 3:
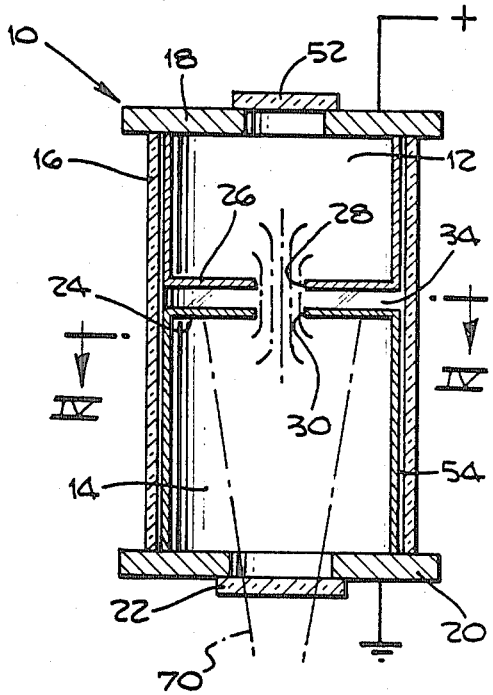
FIG. 3 shows a longitudinal axially directed cross-sectional view of the light initiated high power electronic switch of this invention.

With reference to FIGS. 2, 3, 4, and 7, there is shown a light initiated high powered electronic switch 10 of this invention. The switch is generally cylindrical in shape and has a hermetically sealed envelope 16, made from a dielectric or insulator material which defines the cylindrical portion of the switch. The envelope 16 may be also made from glass so that viewing of the operation of the switch may be accomplished where desirable. In actual operation, however, the envelope 16 need not be optically transparent but preferably a good insulating material having a high dielectric constant, such as a ceramic or glass. The envelope 16 has a conductive upper end cap 18 and a conductive lower end cap 20, which in the preferred embodiment are made of stainless steel. Holes are defined at the center of end caps 18 and 20, and the holes are covered, respectively, by windows 52 and 22. Window 52 is not required operationally and has been used for viewing the switch during performance testing. Window 22 is a light source window and in the preferred embodiment may be made from quartz having an infrared to ultraviolet bandpass capable of allowing optimum transmission of electromagnetic radiation of a wavelength of 308 nanometers. Within the hermetically sealed chamber defined by the envelope 16 is contained an anode cup 12 and a cathode cup 14. The anode and cathode cups in the preferred embodiment may be made from nickel or molybdenum. Copper also has been used to form the cylindrical walls of the anode 12 and cathode 14 cups. A bottom plate 26 is formed at the bottom of the anode cylinder and defines a central aperture 28 which in the preferred embodiment has a diameter of approximately 3 mm. A top plate 24 is positioned at one end of the cathode cup 14 and is juxtaposed opposite the anode bottom plate 26. Like the anode plate 26, the cathode top plate 24 defines a central aperture 30 which is positioned coaxially with the aperture 28 of the anode. Both the anode and cathode apertures 28 and 30 are of substantially equal diameter. The plates 24 and 26 are separated by a gap 34 which is substantially 3 mm, the same distance separation as the diameter of the central apertures 28 and 30. During operational conditions, current discharge 32 flows through the apertures as shown in FIGS. 3 and 7.

The chamber defined by the envelope 16 is filled by a gas such as helium, nitrogen, or hydrogen, or other gases. These gases are allowed to enter the chamber defined by the envelope 16 so that a pressure of 0.1 to 0.5 Torr is maintained.

No heater mechanism is provided for the cathode cup 14; the electronic switch of this invention operates using a cold cathode. Up to 35 kV of stand-off voltage has been achieved. During operation, peak current has been measured as high as 10 k Amps. The current rise rate time defined as dI/dt has been measured at $4\times10''$ Amps/sec.

The electronic switch operates on the left hand side of the hydrogen and helium Paschen curves for electrode materials. It will be noted, especially with references to FIGS. 3 and 4, that a 1 mm gap is maintained between the wall of the anode and cathode cups and the insulative envelope 16, so as to prevent flashing or shorting out of the switch during activation.

Figure 1:
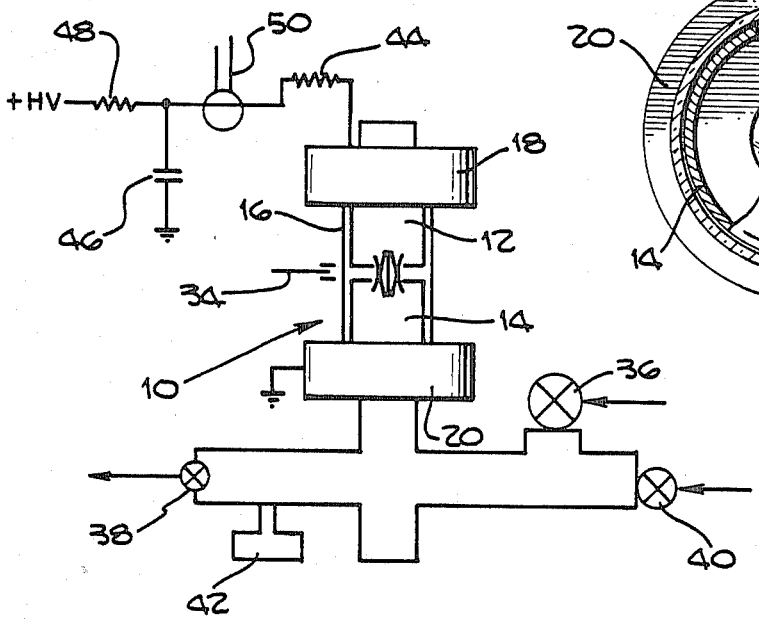
FIG. 1 shows the electronic switch of this invention included within a system for triggering a high energy load.
Figure 4:
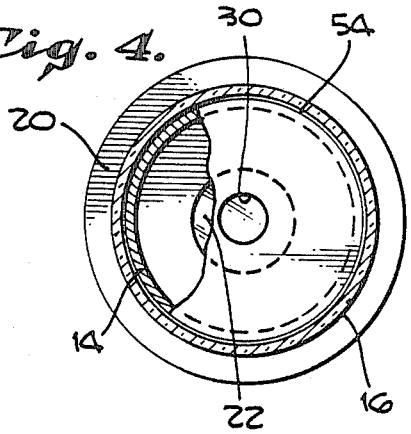
FIG. 4 shows a cross-sectional view of the light initiated high power electronic switch of this invention taken along lines IV—IV of FIG. 3.

Referring now to FIG. 1, an electronic system is shown in which the electronic switch 10 of this invention may operate. The envelope 16 defined within the electronic switch 10 is evacuated by sequential operation of first, the roughing pump 38, and then, the ion pump 40. Once substantially evacuated, helium or hydrogen gas is inlet through the inlet valve 36 and allowed to enter the chamber defined by the insulating envelope 16. A capacitance manometer 42 displays the internal pressure of the electronic switch so that an operator may be able to monitor the pressure and make sure that it remains within the range of 0.1 to 0.5 Torr. As noted with referenced to FIGS. 1 and 3, the cathode cup 14 is grounded through the end plate 20. The anode cup 12 is operatively associated through a network which will subsequently be described with a high voltage source (+HV). The high voltage source (+HV) provides current through resistor 48, which in the embodiment shown in FIG. 1 is rated at 200 kilo-ohms resistance. The capacitor 46 is rated at 0.2 microfarad capacitance. The capacitor 46 acts as an energy storage means for storing the high voltage received by the high voltage source (+HV); and, this capacitor 46 may be replaced by a pulse forming network. When the capacitor 46 is fully charged, the resistor 48 assists in preventing any significant leakage before the closing of the switch. This RC network of resistor 48 and capacitor 46 are tied in series to a low resistance load 44, which experimentally was a copper sulfate solution at a 3 ohm rating, but which may be any load, such as the flash lamp of a laser. These elements may be replaced, alternatively, by a charging power supply. The output waveforms produced when the circuit is operating are monitored by a visually perceivable meter 50 which is tied to a transient digitizer (not shown). When the switch is initially set at an open position, the anode 12 has a stand-off voltage approximately equivalent to the high voltage source (+HV) which in the preferred embodiment may be as high as 35 kV.

When unfocused light 70 (FIG. 3) is directed towards the aperture 28 and 30 upon the back side of the cathode top plate 24, a photoemissive mechanism takes place wherein in the unfocused light 70 initiates and triggers the freeing of electrons from the surface of the back of the cathode. These electrons then interact with gas molecules passing through the central aperture and throughout the hermetically sealed chamber defined by the envelope 16. As the electrons which are knocked from the surface of the back of the cathode plate 24 interact with the molecules of the gas contained within the envelope 16, a chain reaction takes place which results in an avalanche of ionization, and an eventual controlled discharge of the switch across the gap 34 between the plates 26 and 24 through the central apertures 28 and 30. A glow discharge of current may be observed 32 when the switch has been triggered by the unfocused light. The unfocused light may originate from an unfocused laser, as in the preferred embodiment, or may arise from a variety of high energy sources, such as an arc lamp. The unfocused light initiates the discharge of current across the plates through photoemission of electrons from the back of the cathode, rather than through the formation of a plasma at the surface of the cathode. This mechanism of photoemission is not ordinarily possible with a current switch. It has not been possible heretofore to fabricate devices that have photosensitive cathodes and also have cathodes in a region where either the laser trigger or arcing can produce permanent cathode damage. It has been experimentally observed that the least degradation of the electronic switch of this invention occurs within the area where the laser is incident on the cathode. This is opposite the situation for laser triggered spark gaps.

Once the switch 10 is closed, current is allowed to flow through the switch and the capacitor 46 is allowed to discharge through the switch to ground by way of the end plate 20 (See FIG. 1.). Once fully discharged, the capacitor again recharges by means of the high voltage source (+HV). During capacitor recharge, the anode cup 12, through end plate 18, is brought back to a high voltage stand-off and the switch 10 is thereby reopened, wherein the switching cycle may be repeated as often as the laser is able to flash. During experimentation, the rate of triggering of the switch has been laser limited at a repetition rate of approximately 100 hertz. Faster switching laser triggers will in turn initiate faster switching repetition frequencies.

With reference to FIG. 7, a close up view of the anode cup 12 and cathode cup 14 and their respective plates 26 and 24 separated by the gap 34 is shown. A discharge glow 32 is shown to pass through the central apertures of the respective plates 26 and 24. Field lines 66 illustrate the electrical field between the anode plate 26 and the cathode plate 24 immediately prior to full discharge. It will be noted that central aperture field line 68 defines a longer pathway through which the primary discharge of current flow occurs. Current densities as high as 20 kiloamps per square centimeter have been achieved during current flow.

FIG. 5 shows a plot of the Paschen curve and the operating characteristics of the claimed invention. The claimed invention operates on the left side of the Paschen curve 56 between the regions of vacuum operation 58 and the glow discharge region 60 of minimal breakdown. The Guenther article described laser triggered spark gap, shown in FIG. 6, operates on the right hand side of the Paschen curve in the region 62. Area 64 defines the region wherein the electrodes are unable to hold off self-initiated discharge of current across separated electrodes. It is necessary for any gas filled electronic switch to initially operate outside the confines of the region 64 in order to obtain a controllable trigger. Like thyratrons and a pseudospark device hereinbefore described, applicant's invention operates in the region 56 on the left side of the Paschen curve. Thus, applicant's design operates in such a manner that the lower the pressure at a fixed distance, the more voltage one is able to controllably stand off. The applicant's electronic switch 10 operates in an entirely different manner than that of the laser triggered spark gap (shown in FIG. 6) which operates on the right side of the Paschen curve 62. The laser triggered spark gap requires increasingly higher pressures at a greater fixed distances between the electrodes to achieve high stand-off voltage.

The operation of the Guenther prior art device of FIG. 6 is shown in stark contrast to the applicant's design. The cathode 76 of the Guenther device necessarily degrades with time due to the wearing down of its surface by the focused laser beam 72. Applicant avoids this cathode degradation by presenting an unfocused light beam 70 (FIG. 7) on the back of the cathode surface.

While a preferred embodiment of the invention has been described in detail, it must be kept in mind that alternative equivalent and modified configurations of the electronic switch of this invention may also be made according to the teachings of this invention. For example, experimentation has indicated that a graded grid construction may be plausible wherein in addition to the two cups disclosed herein, a plurality of smaller diameter cups may be telescoped within both the anode and cathode, providing an increasingly differing potential cup to cup such that the smallest of the telescoped cathode cups is the most negative and the plurality of layers of cups become continually positive until the smallest anode cup is reached. In this manner of layering of cup construction, one may achieve even greater stand-off voltage than has been achieved with the single anode and cathode cups described in this invention. Therefore, the scope of the appended claims are intended to cover the described preferred embodiment herein, as well as alternative equivalent configurations of the electronic switch of this invention and the triggering system with which it operates.

What is claimed is:

1. A high powered electronic switch, capable of providing a high stand-off voltage, comprising:
a cylindrical anode cup having a bottom plate having a first aperture;
a cylindrical cathode cup having a top plate having a second aperture;
said anode and cathode cups having juxtaposed anode bottom plate to cathode top plate, and being separated by a small gap wherein said first and second apertures are in substantial alignment;
envelope means for hermetically sealing said anode and cathode cups;
ionizable material within said envelope;
means for directing unfocused light toward said apertures, of a sufficiently short wavelength to trigger the flow and discharge of high amperage current across the gap between said top and bottom plates.

2. The high powered gas-filled electronic switch of claim 1, wherein said means for directing unfocused light includes an unfocused laser directed at a quartz window capable of transmitting electromagnetic waves of a wavelength of 308 nm.

3. The high powered gas-filled electronic switch of claim 1, wherein said means for directing unfocused light provides said high amperage current which flows across the gap includes a high current density plasma operating in the pseudospark range of the Paschen curve.

4. The high powered gas-filled electronic switch of claim 1, wherein the envelope of said electronic switch is filled with helium gas at a pressure within the range of 0.1–0.5 Torr.

5. The high powered gas-filled electronic switch of claim 1 wherein photoemission of electrons from the back of the cathode cup, caused by a directed unfocused laser beam, results in the discharge of high amperage current across the gap between said top and bottom plates.

6. A system for triggering a high energy load, such as a laser, comprising:
an electronic switch having an anode cup and a cathode cup;
means for storing electrical energy;
a high voltage source operatively associated with the anode cup of the electronic switch;
said high voltage source associated with said switch through the electrical energy storage means;
said electronic switch comprising:
said anode cup and said cathode cup each having at least a single plate positioned at one end, each plate defining an aperture, said apertures being substantially aligned;
envelope means for hermetically sealing said anode and cathode cups;
means for directing unfocused light toward said apertures of a sufficiently short wavelength at the back of the cathode top plate to trigger flow and discharge of high amperage current across the gap between the respective plates of the anode and cathode; and
means for controlling the flow of gas into said switch, so that said switch operates on the left side of the Paschen curve, whereby when light is applied, the electronic switch is closed and the electrical energy storage means applies a pulse of electrical energy to said load.

7. The system for triggering a high energy load of claim 6 wherein said means for controlling the flow of gas into the envelope defining the switch includes controllable operable gas valves and a capacitive manometer for monitoring the pressure levels contained within the vessels into which gas is allowed to flow.

8. The system of claim 6 for triggering a high energy load wherein said means for storing electrical energy comprises:
a pulse forming network, including a high storage capacitor,
so that said capacitor may discharge through said electronic switch when the switch is closed and may be recharged once fully discharged so as to bring the anode of the electronic switch back to a sufficient stand-off voltage to reopen the switch for further and repeated activation;
where said capacitor is electrically isolated from said unfocused light.

9. A gas filled electronic switch, exhibiting high standoff voltage characteristics, for high power application, comprising:
an elongated, hermetically-sealed, high dielectric constant material envelope, said envelope being filled with ionizable material at a relatively low pressure;
a pair of metallic, conductive cups, positioned bottom to bottom;
each of said cups being cylindrical with flat bottom plates, said plates defining a pair of apertures;
said cups being mounted substantially coaxially within said envelope and separated by a small gap, the distance of which is comparable to the diameter of said central apertures;
means for applying a high voltage between said two cups;
means for operating said electronic switch at a low pressure to maintain a high standoff voltage in the absence of a trigger;
said switch being thermally and electrically isolated from a triggering means.

10. The gas filled electronic switch of claim 9, further including:
a thermally and electrically isolated triggering means, comprising:
a high frequency electromagnetic radiation source means;
said source means producing an unfocused light beam on the backside of said cathode;
whereby, said electronic switch is triggered.

11. The gas-filled electronic switch of claim 10, wherein said radiation source is:
an unfocused laser producing electromagnetic radiation of a wavelength of 308 nm or less.

12. The gas-filled electronic switch of claim 9, wherein said gas filling said envelope is helium at a pressure of 0.1–0.5 Torr, so that said switch operates during voltage standoff at the left side of the Paschen curve.

* * * * *